United States Patent [19]

Otobe et al.

[11] Patent Number: 4,876,995

[45] Date of Patent: Oct. 31, 1989

[54] VALVE OPERATION CONTROL DEVICE FOR INTERNAL COMBUSTION ENGINE

[75] Inventors: Yutaka Otobe, Saitama; Noriyuki Kishi, Tokyo, both of Japan

[73] Assignee: Honda Giken Kogyo Kabushiki Kaisha, Tokyo, Japan

[21] Appl. No.: 210,409

[22] Filed: Jun. 23, 1988

[30] Foreign Application Priority Data

Jun. 25, 1987 [JP] Japan ..... 62-158491

[51] Int. Cl.[4] ..... F01L 9/02; F01L 1/34

[52] U.S. Cl. ..... 123/90.12; 123/90.16; 123/198 D

[58] Field of Search ..... 123/90.16, 90.12, 90.55, 123/90.63, 90.46, 196 S, 198 D, 198 F

[56] References Cited

U.S. PATENT DOCUMENTS 4,111,165 9/1978 Aoyama et al. ..... 123/90.15
4,485,777 12/1984 Nakagami et al. ..... 123/90.15
4,683,854 8/1987 Goulet ..... 123/198 D
4,741,306 5/1988 Watanabe et al. ..... 123/198 D
4,759,322 7/1988 Konno ..... 123/90.44
4,768,471 9/1988 Draxler et al. ..... 123/196 S
4,788,946 12/1988 Inoue et al. ..... 123/90.4
4,790,274 12/1988 Inoue et al. ..... 123/90.16

*Primary Examiner*—Charles J. Myhre
*Assistant Examiner*—Weilun Lo
*Attorney, Agent, or Firm*—Lyon & Lyon

[57] ABSTRACT

Method and apparatus are described for determining the operability, or lack thereof, of a hydraulic pressure-operated selective coupling mechanism for operating an intake valve or an exhaust valve of an internal combustion engine during various modes of engine operation wherein a control means employed to operate the control valve effective for supplying hydraulic pressure to the mechanism is imparted with an indication of the selected mode of intake or exhaust valve operation and of the hydraulic pressure supplied to the mechanism and is operative to compare such indications to determine whether or not they coincide.

13 Claims, 4 Drawing Sheets

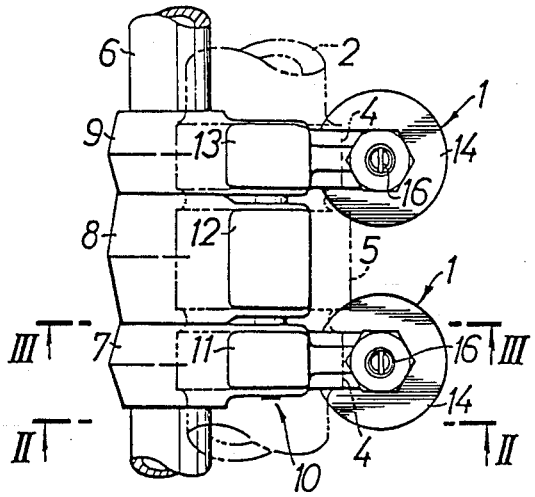
FIG. 1.
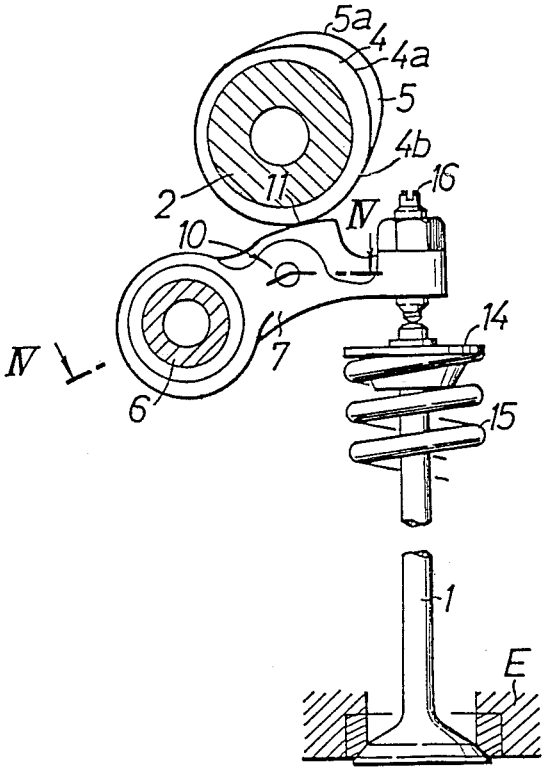
FIG. 2
FIG. 3.
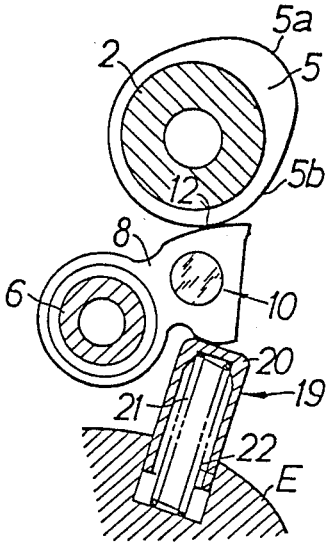

FIG. 5.
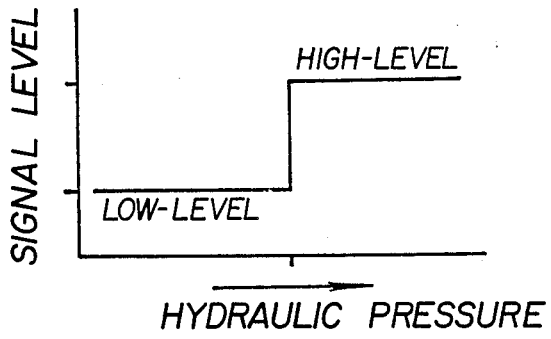
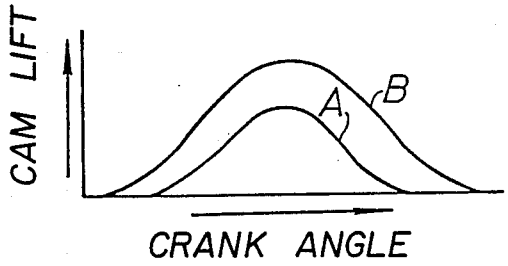
FIG. 7.

VALVE OPERATION CONTROL DEVICE FOR INTERNAL COMBUSTION ENGINE

BACKGROUND OF THE INVENTION

The present invention relates to a valve operation control device for an internal combustion engine having a selective coupling mechanism for selecting one of plural opening/closing modes of an intake or exhaust valve dependent on the hydraulic pressure applied and, particularly, to such a device in which there is a control valve disposed between the selective coupling mechanism and a hydraulic pressure supply source for varying the hydraulic pressure, and a control means connected to the control valve for controlling operation of the control valve dependent upon operating conditions of the engine.

One conventional valve operation control device of the type described is known, for example from Japanese Laid-Open Patent Publication No. 61-19911. In such conventional valve operation control device, a selective coupling mechanism is selectively supplied with lower and higher hydraulic pressures. When the lower hydraulic pressure is supplied, the lift and the opening interval of the controlled intake or exhaust valve are made larger than when the higher hydraulic pressure is supplied. The lower hydraulic pressure is supplied to the selective coupling mechanism when the engine rotates in a low speed range. In practice, if the engine continuously rotates in a high speed range due to a certain failure without switching operation of the selective coupling mechanism being effected, then the valve operating system may malfunction and the output power of the engine is not increased.

In view of the aforementioned problem, it is a first object of the present invention to provide a valve operation control device of an internal combustion engine, which detects the presence of a malfunctioning condition that prevents a selective coupling mechanism to effect switching operation in response to a change in operating conditions of the engine.

A second object of the present invention is to provide a valve operation control device for an internal combustion engine, which, in addition to achievement of the first object, takes appropriate action to avoid the malfunctioning condition when it is detected.

SUMMARY OF THE INVENTION

According to a first aspect of the invention, a hydraulic pressure detector for detecting the hydraulic pressure supplied to a selective coupling mechanism is connected to a control means, the control means being arranged to detect a malfunctioning condition by checking whether a switched mode of the selective coupling mechanism corresponding to the hydraulic pressure detected by the hydraulic pressure detector and a switched mode of the selective coupling mechanism corresponding to a signal for controlling operation of the control valve correspond to each other.

According to a second aspect of the invention, the aforementioned control means is further arranged to issue a signal to avoid the malfunctioning condition.

Therefore, by means of the first aspect of the invention, the failure of supply of a desired hydraulic pressure to the selective coupling mechanism due to an electric or hydraulic pressure system failure can be detected so that the malfunctioning condition can be determined. By means of the second aspect of the invention, when the malfunctioning condition is detected, measures can be taken to avoid the malfunctioning condition. Thus, a valve operating system failure or a reduction of engine power below a desired value can be avoided.

For a better understanding of the invention, its operating advantages and the specific objectives obtained by its use, reference should be made to the accompanying drawings and description which relate to a preferred embodiment thereof.

BRIEF DESCRIPTION OF THE DRAWINGS

FIG. 1 is a plan view of a valve operating device of the type adapted for practice of the present invention;

FIG. 2 is a sectional view taken along line II—II of FIG. 1;

FIG. 3 is a sectional view take along line III—III of FIG. 1;

FIG. 5 is a diagram illustrating the characteristics of an output signal from a hydraulic pressure detector;

FIG. 7 is a plot of cam lift against crank angle for opening intake valves.

DESCRIPTION OF A PREFERRED EMBODIMENT

Figure 4:
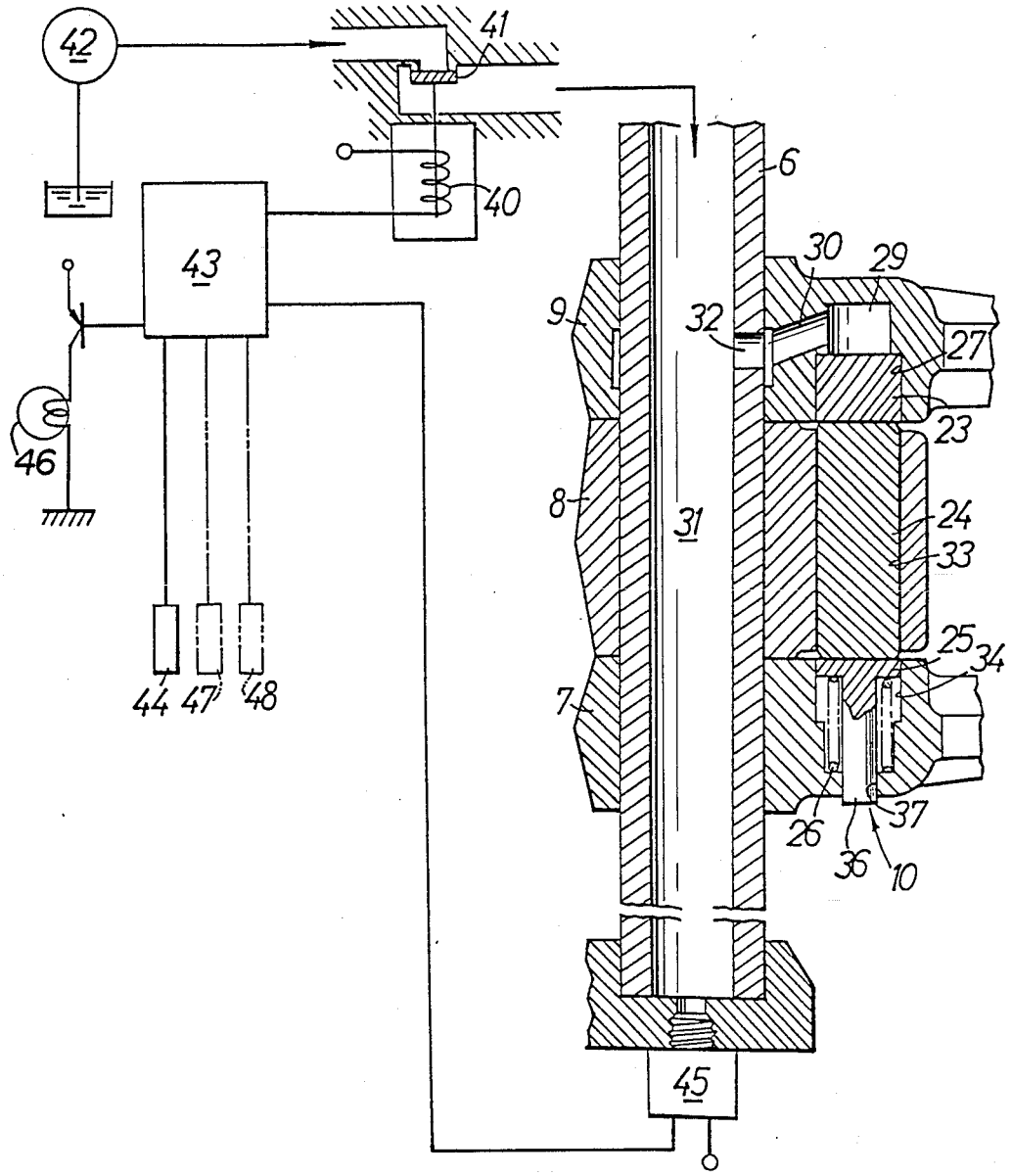
FIG. 4 is a sectional view taken along line IV—IV of FIG. 2 with a schematic representation of the control system of the present invention superimposed thereon.

In FIGS. 1 and 2, a pair of intake valves 1 disposed in an engine body E is opened and closed by a low-speed cam 4, a high-speed cam 5, and a low-speed cam 4 which are integrally formed on a camshaft 2 rotatable by the crankshaft of the engine at a speed ratio of ½ with respect to the speed of rotation of the engine, by first, second, and third rocker arms 7, 8, 9 angularly movably supported on a rocker shaft 6 extending parallel to the camshaft 2, and by a selective coupling mechanism 10 disposed between the first, second, and third rocker arms 7, 8, 9.

The camshaft 2 is rotatably disposed above the engine body E. The low-speed cams 4 are integrally formed on the camshaft 2 in alignment with the intake valves 1, respectively. The high-speed cam 5 is integrally formed on the camshaft 2 between the low-speed cams 4. Each of the low-speed cams 4 includes a cam lobe **4*a* projecting radially outwardly from the camshaft 2 to a relatively smaller extent, and a base circle portion 4*b*. The high-speed cam 5 includes a cam lobe 5*a* projecting radially outwardly from the camshaft 2 to a larger extent and having a greater angular interval than the cam lobe 4*a*, and a base circle portion 5*b***.

The rocker shaft 6 is fixedly positioned below the camshaft 2. The first rocker arm 7 operatively coupled to one of the intake valves 1, the third rocker arm 9 operatively coupled to the other intake valve 1, and the second rocker arm 8 disposed between the first and third rocker arms 7, 9 are pivotally supported on the rocker shaft 6 in axially adjacent relation. The first rocker arm 7 has on its upper surface a cam slipper 11 held in slidable contact with the low-speed cam 4. The second rocker arm 8 has on its upper surface a cam slipper 12 held in slidable contact with the high-speed cam 5. The third rocker arm 9 has on its upper surface a cam slipper 13 held in slidable contact with the low-speed cam 4.

Flanges 14 are attached to the upper ends of the intake valves 1. The intake valves 1 are normally urged in a closing direction, i.e., upwardly, by valve springs 17 disposed between the flanges 16 and the engine body E. Tappet screws 18 are adjustably threaded in the distal ends of the first and third rocker arms 7, 9 in abutting engagement with the upper ends of the intake valves 1.

As shown in FIG. 3, the second rocker arm 8 extends slightly from the rocker shaft 6 toward the intake valves 1. The second rocker arm 8 is normally resiliently urged in a direction to slidably contact the high-speed cam 5 by resilient urging means 19 disposed between the second rocker arm 8 and the engine body E.

The resilient urging means 19 comprises a cylindrical, bottomed lifter 20 with its closed end held against the second rocker arm 8, and a lifter spring 21 disposed between the lifter 20 and the engine body E. The lifter 20 is slidably fitted in a bottomed hole 22 defined in the engine body E.

As shown in FIG. 4, the selective coupling mechanism 10 is disposed between the rocker arms 7 through 9 for selectively connecting and disconnecting them. The selective coupling mechanism 10 comprises a first switching pin 23 for connecting the third and second rocker arms 9, 8, a second switching pin 24 for connecting the second and first rockers arms 8, 7, a third switching pin 25 for limiting movement of the first and second switching pins 23, 24 and a return spring 26 for urging the coupling pins 23 through 25 in a direction to disconnect the rocker arms 7, 8, 9.

The third rocker arm 9 has a bottomed guide hole 27 opening toward the second rocker arm 8 and parallel to the rocker shaft 6, with the first switching pin 23 slidably fitted in the guide hole 27. A hydraulic chamber 29 is defined between the first switching pin 23 and the closed end of the guide hole 27. The third rocker arm 9 has a communication passage 30 defined therein in communication with the hydraulic chamber 29. The rocker shaft 6 has a hydraulic pressure supply passage 31 defined therein. The communication passage 30 and the hydraulic pressure supply passage 31 are held in communication with each other at all times, irrespective of how the third rocker arm 9 may be angularly moved, through a communication hole 32 defined in a side wall of the rocker shaft 6.

The second rocker arm 8 has a guide hole 33 having the same diameter as that of the guide hole 27 and extending between the side surfaces of the second rocker arm 8 parallel to the rocker shaft 6 for registration with the guide hole 27. The second switching pin 24 is slidably fitted in the guide hole 33.

The first rocker arm 7 has a bottomed guide hole 34 having the same diameter as that of the guide hole 33 and opening toward the second rocker arm 8 parallel to the rocker shaft 6 for registration with the guide hole 33. The third switching pin 25 is slidably fitted in the guide hole 34. A shaft portion 3 coaxial and integral with the third switching pin 25 extends through a guide hole 37 defined in the closed end of the guide hole 34. The return coil spring 26 is disposed between the closed end of the guide hole 34 and the third switching pin 25 around the shaft portion 36 for normally urging the mutually abutting switching pins 23 through 25 in a rocker arm disconnecting direction, i.e., toward the hydraulic chamber 29.

When the hydraulic pressure supplied to the hydraulic chamber 29 is relatively low, e.g., when the hydraulic pressure is released from the hydraulic chamber 29, the switching pins 23 through 25 are biased in the disconnecting direction under the force of the return spring 26. In this condition, the mutually abutting surfaces of the first and second switching pins 23, 24 lie between the third and second rocker arms 9, 8, and the second and third switching pins 24, 25 lie between the second and first rocker arms 8, 7, so that the rocker arms 7 through 9 are not interconnected. When higher hydraulic pressure is supplied to the hydraulic chamber 29, the switching pins 23 through 25 are moved in a direction away from the hydraulic chamber 29 against the resiliency of the return spring 26 to insert the first switching pin 23 into the guide hole 33 and insert the second switching pin 24 into the guide hole 34, whereupon the rocker arms 7 through 9 are interconnected.

The hydraulic pressure supply passage 31 in the rocker shaft 6 is connected to a hydraulic pressure pump 42 serving as a hydraulic pressure supply source through a control valve 41 which can selectively be opened and closed in response to energization and de-energization of a solenoid 40. When the control valve 41 is opened, higher hydraulic pressure is supplied to the hydraulic chamber 29 in the selective coupling mechanism 10. When the control valve 41 is closed, the hydraulic chamber 29 is released of hydraulic pressure.

The solenoid 40 is selectively energized and de-energized by a control means 43, such as a computer. The control means 43 opens the control valve 41 when the rotational speed of the engine, detected by a speed detector 44, exceeds a preset value. The control means 43 is supplied with a signal from a hydraulic pressure detector 45 which is attached to the rocker shaft 6 for detecting the hydraulic pressure in the hydraulic pressure supply passage 31 communicating with the hydraulic chamber 29. The hydraulic pressure detector 45 comprises a pressure switch, for example. As shown in FIG. 5, when the hydraulic pressure in the hydraulic pressure supply passage 31 is higher, the hydraulic pressure detector 45 issues a high-level signal, and when the hydraulic pressure in the hydraulic pressure supply passage 31 is lower, e.g., zero, the hydraulic pressure detector 45 issues a low-level signal. The control means 43 is capable of checking how the signal for controlling the solenoid 4 and the signal from the hydraulic pressure detector 45 correspond to each other. More specifically, the control means 43 checks whether a high-level signal is applied from the hydraulic pressure detector 45 when the solenoid 40 has been energized, and also whether a low-level signal is applied from the hydraulic pressure detector 45 when the solenoid 40 has been de-energized. If the signal from the hydraulic pressure detector 45 is low in level when the solenoid 40 is supposed to be energized, then the control means 43 cuts fuel to be supplied to the engine, for example, and energizes an alarm lamp 46 as an alarm unit. If the signal from the hydraulic pressure detector 45 is high in level when the solenoid 40 is supposed to be de-energized, then the control means 43 energizes the alarm lamp 46.

Figure 6:
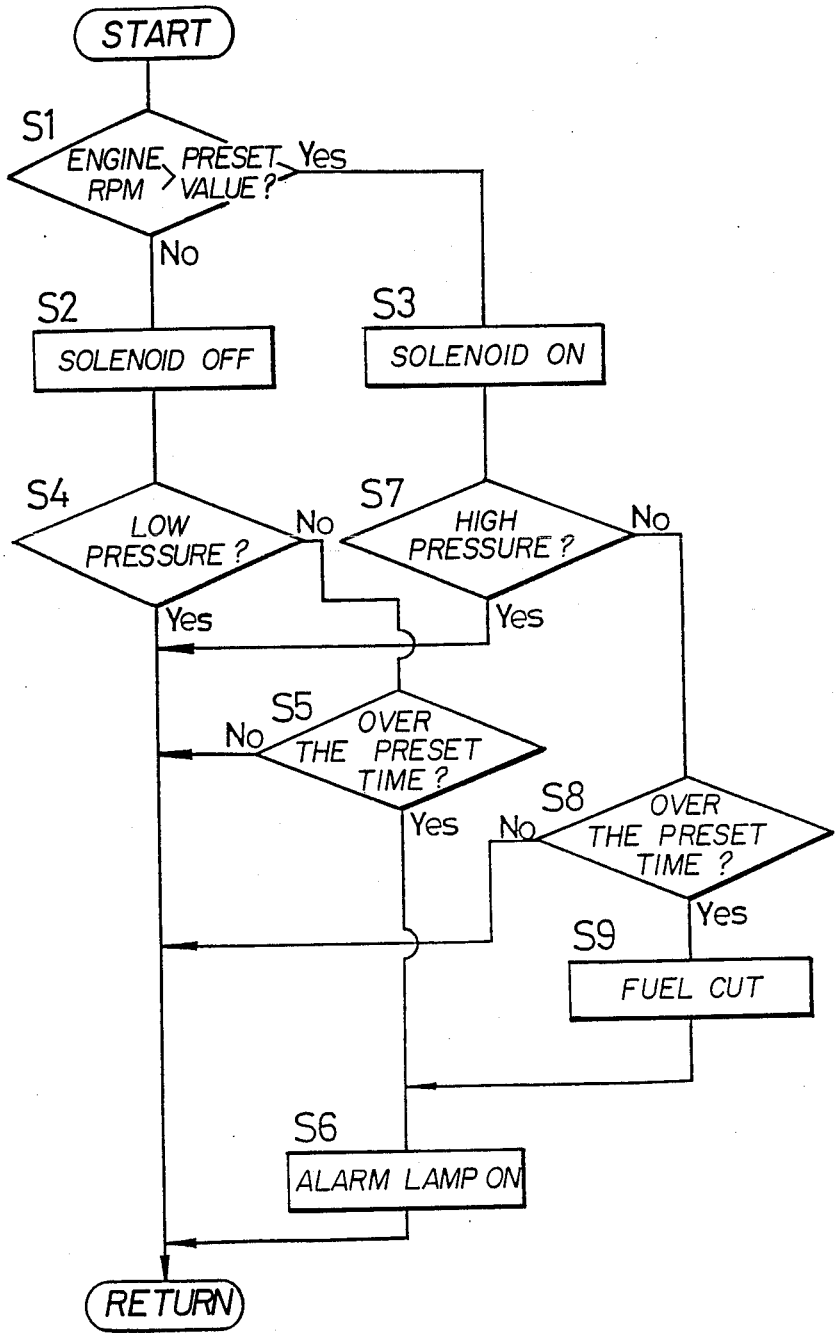
FIG. 6 is a flow diagram of a control sequence performed by the control means of the present invention.

Operation of the embodiment will be described below with reference to FIG. 6. The control means 43 checks in step S1 whether the engine rotational speed detected by a speed detector 44 is lower than a preset value or not. If the detected engine rotational speed is lower than the preset value, then the control means 43 issues a signal to de-energize the solenoid 40 in step S2. If the detected engine rotational speed is higher than the preset value, then the control means 43 issues a signal to energize the solenoid 40 in step S3. When the solenoid 40 is de-energized, the control valve 41 is closed to release the hydraulic pressure from the hydraulic chamber 29 and hence the rocker arms 7 through 9 are disconnected. The intake valves 1 are now opened and closed according to a pattern indicated by the curve A in FIG. 7 dependent on the cam profile of the low-speed cams 4. When the solenoid 40 is energized, the control valve 41 is opened to supply higher hydraulic pressure into the hydraulic chamber 29 for thereby connecting the rockers arms 7 through 9. The intake valves 1 are now opened and closed according to a pattern indicated by the curve B in FIG. 7 dependent on the cam profile of the high-speed cam 5.

After the signal has been issued to de-energize the solenoid 40, step S4 checks whether the signal from the hydraulic pressure detector 45 is low in level or not. If high in level, step S5 checks whether the high level signal from the hydraulic pressure detector 45 has continued over a preset period of time which is selected taking into consideration an operation delay that is expected due to the viscosity of the working oil and other factors. If the preset time has elapsed, an alarm lamp 46 is energized in step S6. Therefore, the malfunctioning condition in which the rocker arms 7 through 9 are interconnected and hence the intake valves 1 are opened and closed by the high-speed cam 5 when the intake valves 1 are supposed to be opened and closed by the low-speed cams 1 can be detected and an alarm can be issued.

After the signal has been issued to energize the solenoid 40 in the step S3, step S7 checks whether the signal from the hydraulic pressure detector 45 is high in level or not. If low in level, step S8 checks whether the low level signal from the hydraulic pressure detector 45 has continued over the preset period of time referred to above. If the low level signal has continued over the preset time, fuel supplied to the engine is cut, for example, in step S9 to prevent the engine rotational speed from being increased for engine protection, and then the alarm lamp 46 is energized in the step S6.

Therefore, the malfunctioning condition of the intake valves 1 due to a failure of the electric or hydraulic pressure system of the valve operating device is detected by the control means 43, which can energize the alarm lamp 46 and also can detect an engine rotational speed set at a value lower than a normal rotational speed setting for preventing excessive engine rotation, to cut fuel supply for avoiding the malfunctioning condition.

In the above embodiment, operation of the selective coupling mechanism 10 is controlled by the engine rotational speed. However, as indicated by the two-dot-and-dash lines in FIG. 4, a detector 47 for detecting a throttle valve opening or a vacuum in the intake manifold, and a detector 48 for detecting the temperature of the engine may be connected to the control means 43, and operation of the selective coupling mechanism 10 may be controlled dependent on output signals from the detectors 47, 48.

It will be appreciated that, according to the first aspect of the invention, as described above, the control means is connected to the hydraulic pressure detector for detecting the hydraulic pressure supplied to the selective coupling mechanism, and is arranged to detect a malfunctioning condition by checking whether the switched mode of the selective coupling mechanism corresponding to the hydraulic pressure detected by the hydraulic pressure detector and the switched mode of the selective coupling mechanism corresponding to the signal for controlling operation of the control valve correspond to each other. The malfunctioning condition in which the intake or exhaust valves do not operate according to the command from the control means due to a failure of the electric or hydraulic pressure system can be detected immediately and measures can be taken to avoid the malfunctioning condition.

According to the second aspect of the invention, in addition to the aforementioned aspect, the control means is adapted to issue a signal to avoid a malfunction when the malfunction is detected. Therefore, in addition to the advantages that can be derived from the aforementioned first aspect of the invention, measures can be taken to avoid the malfunction, and the valve operating system is positively prevented from incurring a failure.

It will be understood, therefore, that variations, changes in the details, materials, and arrangement of the parts which have been herein described and illustrated in order to explain the nature of the invention may be made by those skilled in the art within the principles and scope of the invention. It should be particularly appreciated, moreover, that the present invention is applicable to not only a device for operating the intake valves as described, but also to a device for operating exhaust valves as well.

We claim:

1. In a valve operation system for an internal combustion engine having a selective coupling mechanism for operating an engine operating valve in one of a plurality of opening and closing modes of operation dependent on the level of hydraulic pressure applied to said mechanism, a control valve disposed between said selective coupling mechanism and a hydraulic pressure source for varying the level of hydraulic pressure supplied to said mechanism, and control means for controlling the operation of said control valve dependent upon the operating conditions of said engine, means for determining the operability of said valve operation system comprising:

a hydraulic pressure detector for detecting the level of hydraulic pressure supplied to said selective coupling mechanism;

means for imparting to said control means a signal representative of the respective modes of operation of said control valve;

means for imparting to said control means signals representative of the level of pressure detected by said hydraulic pressure detector; and said control means including means for comparing the signals imparted thereto by said two signal imparting means for determining whether said signals correspond to each other.

2. The operability detecting means of claim 1 in which said control means includes means for establishing a predetermined time period over which said two signals are compared before a determination of correspondence is made.

3. The operability detecting means of claim 1 including means actuated by said control means for issuing a signal indicative of a failure of said two signals to correspond.

4. The operability detecting means of claim 3 including an alarm unit, and means actuated by said control means for operating said alarm unit when said two signals fail to correspond.

5. The operability detecting means according to either one of claims 3 or 4 including means operated by said control means for terminating fuel supply to said engine when said two signals fail to correspond.

6. The operability detecting means according to claim 1 including an engine speed detector for determining the operating conditions of said engine.

7. The operability detecting means according to claim 1 including means for detecting throttle valve opening for determining the operating conditions of said engine.

8. The operability detecting means according to claim 1 including means for detecting intake manifold vacuum for determining the operating conditions of said engine.

9. The operability detecting means according to claim 1 including means for detecting engine temperature for determining the operating conditions of said engine.

10. A method of determining the operability of a valve operation system for use in an internal combustion engine having a selective coupling mechanism for operating an engine operating valve in one of a plurality of opening and closing modes of operation dependent on the level of hydraulic pressure applied to said mechanism, a control valve for supplying hydraulic pressure to said mechanism at different levels, and control means for controlling the operation of said control valve dependent upon the operating conditions of said engine, comprising the steps of:

imparting to said control means an indication of the desired mode of operation of said control valve;

detecting the level of hydraulic pressure supplied to said selective coupling mechanism;

imparting to said control means an indication of the detected level of hydraulic pressure;

comparing the indications supplied to said control means; and determining whether said indications correspond to each other.

11. The method according to claim 10 including the step of delaying the determination of whether said indications correspond to each other for a predetermined time period after said indications are supplied to said control means.

12. The method according to claim 10 or 11 including the step of actuating an alarm when said indications fail to correspond to one another.

13. The method according to claim 10 or 11 including the step of terminating fuel supply under a prescribed operating condition of said engine when said indications fail to correspond to one another.

* * * * *